US011136173B2

(12) United States Patent
Elkind et al.

(10) Patent No.: US 11,136,173 B2
(45) Date of Patent: Oct. 5, 2021

(54) CHILD-RESISTANT STORAGE CONTAINER

(71) Applicant: Sto Responsible, LLC, Lafayette, CO (US)

(72) Inventors: Sandra Elkind, Lafayette, CO (US); Shuichi Amano, Bethlehem, PA (US); Michael Creighton, Warrington, PA (US)

(73) Assignee: STO RESPONSIBLE, LLC, Lafayette, CO (US)

( * ) Notice: Subject to any disclaimer, the term of this patent is extended or adjusted under 35 U.S.C. 154(b) by 87 days.

(21) Appl. No.: 16/108,903

(22) Filed: Aug. 22, 2018

(65) Prior Publication Data

US 2019/0344937 A1 Nov. 14, 2019

Related U.S. Application Data

(60) Provisional application No. 62/670,493, filed on May 11, 2018.

(51) Int. Cl.
*B65D 50/04* (2006.01)
*B65D 45/18* (2006.01)

(52) U.S. Cl.
CPC ..... *B65D 50/04* (2013.01); *B65D 45/18* (2013.01); *B65D 2215/02* (2013.01)

(58) Field of Classification Search
CPC .... B65D 60/04; B65D 45/18; B65D 2215/02; B65D 50/04; B65D 50/02; B65D 50/046;
(Continued)

(56) References Cited

U.S. PATENT DOCUMENTS

D168,205 S 11/1952 R.A. Baustian et al.
2,936,189 A 5/1960 Pearson
(Continued)

FOREIGN PATENT DOCUMENTS

CA 2428862 11/2004
DE 225115 A1 7/1985
(Continued)

OTHER PUBLICATIONS

Life Without Plastic, "Stainless Steel Airtight Watertight Food Storage Container" as soon on Aug. 6, 2018, https://www.lifewithoutplastic.com/store/stainless-steel-airtight-watertight-food-storage-container-lunch-box-8-cm-3.html.
(Continued)

*Primary Examiner* — Robert Poon
(74) *Attorney, Agent, or Firm* — Holland & Hart LLP

(57) ABSTRACT

The technology disclosed herein includes methods and apparatus of a childproof storage container, which includes a lid and a base portion with seesaw-style latches. The seesaw-style latches are configured to unlock a childproof storage container in a locked position upon simultaneously release. Each seesaw-style latch may include a flared end. In a locked position, the childproof storage container may be unlocked and opened upon depression of the flared end of the seesaw-style latch, which rotates the seesaw-style latch from the lid. Each seesaw-style latch may include a standing rib to prevent over-rotation of each seesaw-style latch and/or a chamfer to facilitate closure. The base portion may include a base portion flange, which includes a plurality of female recesses to receive the plurality of male teeth of a lid flange. The base portion and the lid may include opposing walls that interlock during a closed position and/or a gasket for sealing.

16 Claims, 10 Drawing Sheets

(58) Field of Classification Search
CPC ..... B65D 50/00; B65D 50/045; B65D 45/16; B65D 2215/1016; B65D 2215/1066; B65D 2215/1075; B65D 2215/1058; B65D 43/0202; B65D 43/162; B65D 43/265; B65D 43/267; B65D 43/26; B65D 43/22; B65D 11/10
USPC ..... 220/835
See application file for complete search history.

(56) References Cited

U.S. PATENT DOCUMENTS 3,348,724 A 10/1967 Rosso
3,651,983 A 3/1972 Haugen
3,885,715 A 5/1975 Lowry
3,894,655 A 7/1975 Mattheis et al.
3,907,103 A 9/1975 Shaw
3,933,381 A 1/1976 Schurman
4,098,430 A 7/1978 Mattheis et al.
4,102,452 A * 7/1978 Sato ..... B65D 1/22 206/387.13
4,280,648 A 7/1981 Boursier
4,730,731 A 3/1988 Allison
4,746,008 A * 5/1988 Heverly ..... B65D 55/02 206/1.5
4,974,740 A 12/1990 Niles et al.
5,033,634 A 7/1991 Batchelor et al.
5,065,887 A * 11/1991 Schuh ..... B65D 43/164 206/205
5,238,142 A 8/1993 Hanna et al.
5,353,946 A 10/1994 Behrend
D353,048 S 12/1994 VanSkiver
D356,256 S 3/1995 Romanoff
D382,114 S 8/1997 Dickinson
D384,502 S 10/1997 Seager et al.
D389,309 S 1/1998 Shaw
5,718,347 A 2/1998 Walker et al.
5,740,938 A 4/1998 Hoffmann et al.
5,752,615 A 5/1998 Hofmann et al.
D394,955 S 6/1998 Dickinson
D397,870 S 9/1998 De Winter
D407,557 S 4/1999 Jones
D409,484 S 5/1999 Tasker
D414,934 S 10/1999 Dickinson
6,021,901 A 2/2000 Wolfe
D427,769 S 7/2000 Zimmerman
6,085,928 A 7/2000 Dickinson et al.
D438,005 S 2/2001 Tiramani et al.
D440,401 S 4/2001 Pauser et al.
D441,954 S 5/2001 Parker
D457,919 S 5/2002 Whittier et al.
6,401,968 B1 6/2002 Huang et al.
6,446,806 B1 9/2002 Ohori et al.
6,454,115 B1 9/2002 Allasia
D466,299 S 12/2002 Zimmerman
D480,872 S 10/2003 Welsh et al.
6,631,805 B2 10/2003 Bramen
D489,530 S 5/2004 Lindsay
D490,277 S 5/2004 Kim
6,789,692 B2 9/2004 Prezelin
6,793,096 B1 9/2004 Seok
6,832,686 B2 12/2004 Donegan
D501,722 S 2/2005 Zimmerman
D510,802 S 10/2005 Sagol
D511,247 S 11/2005 Tsuchiya
D511,624 S 11/2005 Rosine et al.
D513,870 S 1/2006 Rosine et al.
D514,810 S 2/2006 Armato
D521,732 S 5/2006 Guizzardi
7,090,089 B2 8/2006 Lown et al.
D531,798 S 11/2006 Ringo
7,296,730 B2 11/2007 Erdie
D560,489 S 1/2008 Satnick
D567,507 S 4/2008 Zimmerman
D577,928 S 10/2008 Wong
D593,324 S 6/2009 Simas
7,540,364 B2 6/2009 Sanderson
7,549,541 B2 6/2009 Brozell et al.
D597,834 S 8/2009 Mittelstaedt et al.
7,568,739 B2 8/2009 Lee
7,581,670 B2 9/2009 Erdie
7,581,671 B2 9/2009 Erdie
7,918,357 B2 4/2011 Jaeb
7,997,412 B2 8/2011 Henry et al.
D644,437 S 9/2011 Lintula
D645,248 S 9/2011 Osiecki et al.
8,038,025 B2 10/2011 Stark et al.
D650,174 S 12/2011 Ahlstrom
8,079,467 B2 12/2011 Barnette et al.
D654,690 S 2/2012 Sofy et al.
8,162,144 B2 4/2012 Intini
D658,374 S 5/2012 Anderson et al.
D664,767 S 8/2012 Shewmaker
D677,892 S 3/2013 Van Ness
D687,224 S 8/2013 Lacroix
8,534,492 B2 9/2013 Smyers et al.
8,567,828 B2 10/2013 Andren et al.
8,596,485 B2 12/2013 Lindsay
D701,044 S 3/2014 Kishimoto
D711,103 S 8/2014 Wu et al.
8,870,021 B2 10/2014 Smyers
D733,320 S 6/2015 Perry et al.
9,108,776 B2 8/2015 Smyers et al.
9,114,909 B2 8/2015 Wagner
D738,623 S 9/2015 Wood
D748,916 S 2/2016 Nilsson
D751,215 S 3/2016 Perry et al.
9,272,820 B2 3/2016 Cowie
9,295,349 B2 3/2016 Smyers
9,387,963 B2 7/2016 McBroom et al.
D775,826 S 1/2017 Gettel
D784,629 S 4/2017 Farrish
9,637,281 B2 5/2017 Koo
D788,465 S 6/2017 Spadotto
D790,219 S 6/2017 Huang
D814,920 S 4/2018 Georgiadis et al.
D821,749 S 7/2018 Nillson
D834,819 S 12/2018 Burek et al.
D849,405 S 5/2019 Chen
2002/0084239 A1 7/2002 Dressel et al.
2003/0015534 A1 1/2003 Lown et al.
2004/0118848 A1* 6/2004 Marshall ..... B65D 43/169 220/266
2004/0195241 A1 10/2004 Stull et al.
2005/0194391 A1 9/2005 Domke et al.
2006/0249522 A1 11/2006 Ringo
2008/0006631 A1 1/2008 Booth et al.
2009/0255842 A1 10/2009 Brozell et al.
2009/0283437 A1 11/2009 Angelucci et al.
2010/0200581 A1 8/2010 Maltz
2010/0308055 A1* 12/2010 Sams ..... B65D 43/169 220/324
2011/0127264 A1 6/2011 Whalen
2013/0105482 A1* 5/2013 Letica, II ..... B65D 41/06 220/293
2014/0151388 A1 6/2014 Culeron et al.
2014/0319147 A1 10/2014 Horovitz et al.
2015/0136786 A1 5/2015 Lonner et al.
2016/0244216 A1 8/2016 Decarlo et al.
2016/0297575 A1 10/2016 McBroom et al.
2016/0332785 A1 11/2016 Sexton et al.
2017/0001764 A1* 1/2017 Belleville ..... B65D 43/162
2017/0036842 A1 2/2017 Lonner et al.
2017/0137184 A1 5/2017 Burek et al.
2017/0174411 A1 6/2017 Lonner et al.
2017/0247151 A1* 8/2017 Chiou ..... B65D 43/163
2017/0334615 A1 11/2017 Golta et al.
2018/0244438 A1* 8/2018 Morichon ..... B65D 43/162
2018/0265263 A1* 9/2018 Li ..... B65D 53/02

FOREIGN PATENT DOCUMENTS

DE 9410519 8/1994
EP 1088769 4/2001

(56) References Cited

FOREIGN PATENT DOCUMENTS

| | | | |
|---|---|---|---|
| GB | 2300854 | | 11/1996 |
| GB | 2482507 | A1 | 2/2012 |
| JP | 3062266 | | 9/1999 |
| WO | 03/076292 | A1 | 9/2003 |
| WO | 2011162621 | | 12/2011 |
| WO | 2016075027 | | 5/2016 |
| WO | 2017083099 | | 5/2017 |
| WO | 2018/081681 | A1 | 5/2018 |

OTHER PUBLICATIONS

International Search Report & Written Opinion, PCT/US2018/047543, dated Feb. 11, 2019.

Healthcare Packaging, "STO Responsible: Sustainable, Child-Resistant Box," Posted Oct. 24, 2018 (https://www.healthcarepackaging.com/markets/cannabis/press-release/13295484/sto-responsible-sustainable-childresistant-box) (Year: 2018).

Kickstarter, "CRATIV Child-Resistant Packaging," Project launched Oct. 10, 2016 (https://www.kickstarter.com/projects/1276263290/crativ-child-resistant-packaging/description) (Year: 2016).

* cited by examiner

CHILD-RESISTANT STORAGE CONTAINER

CROSS-REFERENCE TO RELATED APPLICATIONS

The present application is a non-provisional application which claims the benefit of priority to U.S. Provisional Patent Application No. 62/670,493, entitled "Childproof Storage Container" filed on May 11, 2018, which is specifically incorporated by reference herein for all that it discloses or teaches.

BACKGROUND

Cartons, vials, bottles, boxes, or other paperboard or plastic containers may be used for holding and storing items. In some implementations, the items held or stored in the containers may be harmful to certain users, such as children (e.g., a pharmaceutical drug). A user may desire to hold or store items in a lockable, child-resistant or childproof container.

SUMMARY

The disclosed technology includes methods and apparatus of a childproof storage container. The childproof storage container includes a lid and a base portion with seesaw-style latches. The seesaw-style latches are configured to unlock the childproof storage container in a locked position upon simultaneously release. Each seesaw-style latch may include a flared end, where upon depression of the flared end, the seesaw-style latch rotates and dislodges from a locked position on the lid. In some implementations, each seesaw-style latch includes a standing rib (or stop) to prevent over-rotation of each seesaw-style latch. In some implementations, the base portion includes a base portion exterior flange, which includes female recesses to receive corresponding male teeth of a lid exterior flange.

In some implementations, the lid includes a lid exterior flange and a lid interior flange, and the base portion includes a base portion exterior flange and a base portion interior flange, where the lid exterior flange nests in a channel located between the base portion exterior flange and the base portion interior flange, and the lid exterior flange locates inside the base portion. In some implementations, the childproof storage container may include at least one gasket. For example, a gasket may be located in a channel in between the base portion exterior flange and the base portion interior flange. In another example, the gasket may be located in a channel in between the lid exterior flange and the lid interior flange. In some implementations, each seesaw-style latch of the childproof storage container may include a chamfer to facilitate closure of the childproof storage container.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations as further illustrated in the accompanying drawings and defined in the appended claims.

These and various other features and advantages will be apparent from a reading of the following Detailed Description.

DETAILED DESCRIPTION

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular implementations, it should be appreciated that the features described with respect to one implementation may be incorporated with other implementations as well. Similarly, however, no single feature or features of any described implementation should be considered essential to the invention, as other implementations of the invention may omit such features.

The disclosed methods and apparatus include a storage container (e.g., a childproof storage container, a locking storage apparatus, a childproof container, lockable container, etc.) that reduces the risk of children, or other individuals, accessing the contents inside the apparatus. The apparatus may have varying dimensions and volume capacities depending on the intended goods used by end users. In some implementations, the apparatus can be configured for single- or multiple-dose solids or liquids, or other contents. The apparatus can be made of a variety of semi-rigid, deflectable, and/or flexible materials, including thermoplastics (e.g., polypropylene, polyethylene terephthalate, high density polyethylene, polyvinyl chloride, low density polyethylene, polypropylene, polystyrene, etc.).

Figure 1A:
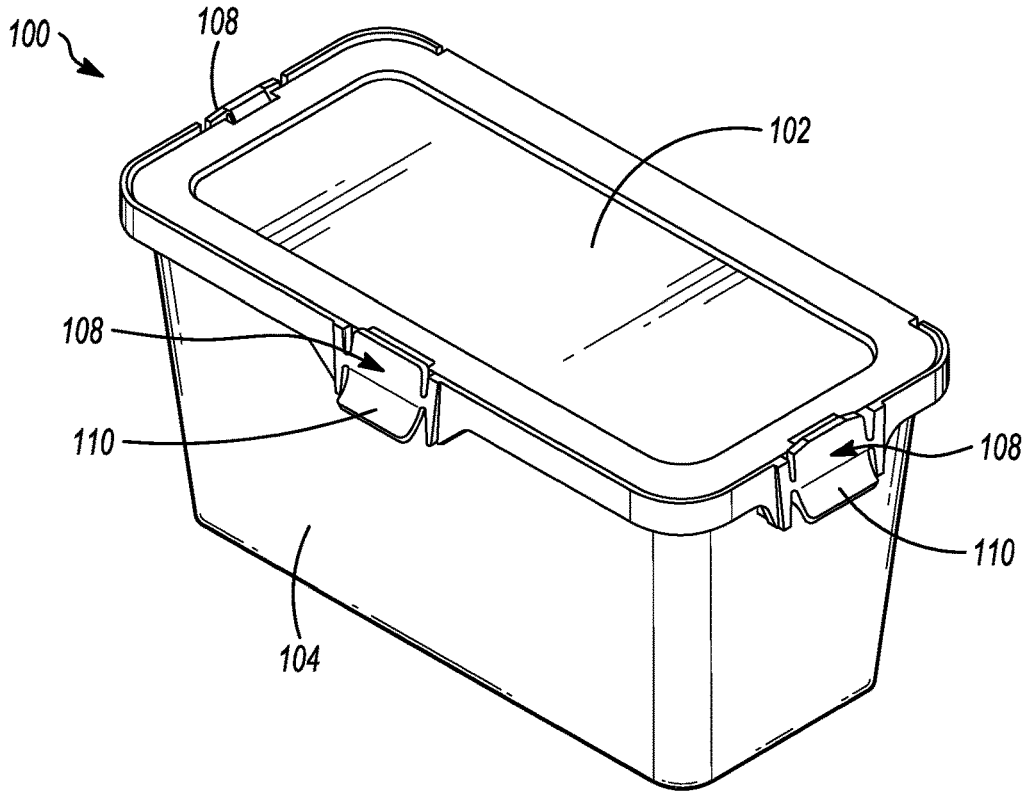
FIG. 1A illustrates a front perspective view of an example storage container in a closed and locked position.

FIG. 1A illustrates a front perspective view of an example storage container 100 in a closed and locked position. The storage container 100 includes a lid 102 and a base portion 104. In some implementations, the lid 102 may be attached to the base portion 104 by at least one hinge (see hinge 106 in FIG. 1B).

The base portion 104 further includes a plurality of seesaw-style latches (e.g., seesaw-style latch 108). For purposes of this disclosure, a "seesaw-style latch" is a latch that lodges and locks onto a latch landing (not shown, shown and described in FIG. 3B, latch landing 342) of a storage container 100, securing two components (e.g., the lid 102 and the base portion 104) of the storage container 100 to each other. The seesaw-style latch 108 may be located on the base portion 104 of the storage container 100 and lock onto a latch landing located on the lid 102 via a lip 138 (not shown) on the interior of the seesaw-style latch 108. In some implementations, the latch may be located on the lid 102 and the latch landing may be located on the base portion 104.

In some implementations, the seesaw-style latches 108 may be three seesaw-style latches 108 on one storage container 100. The seesaw-style latches 108 are configured to lock the base portion 104 to the lid 102 and unlock the base portion 104 from the lid 102 upon release of the seesaw-style latches 108.

Specifically, to lock the base portion 104 to the lid 102, the lid 102 can be rotated toward a base portion 104 of the storage container 100. The lid 102 is pushed down or slid into the seesaw-style latches 108 located on the base portion 104.

Figure 5A:
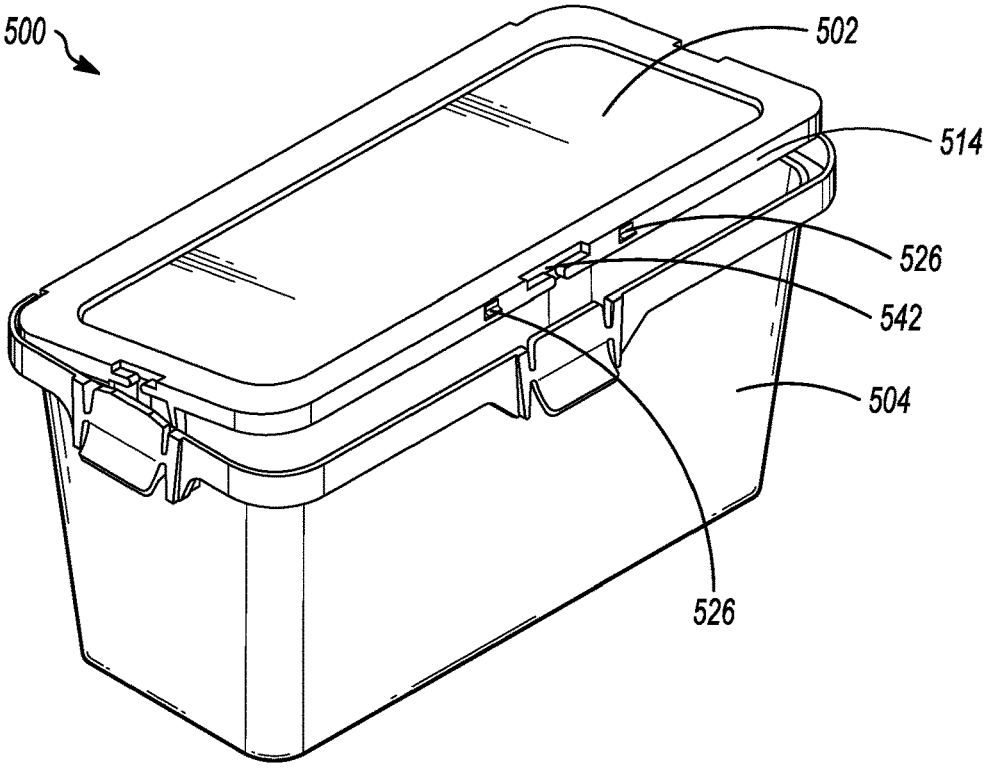
FIG. 5A illustrates a front perspective view of an example storage container in a partially open and unlocked position.
Figure 5B:
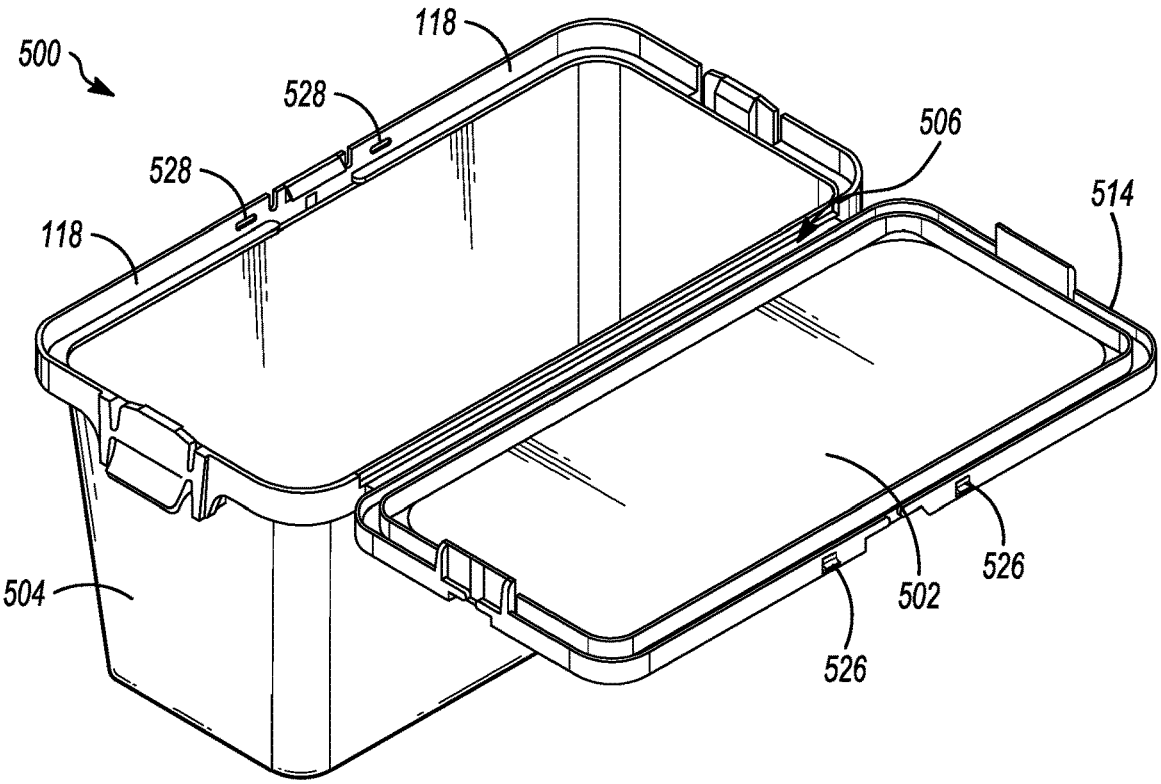
FIG. 5B illustrates a back perspective view of an example storage container in an open and unlocked position.

In some implementations, as the lid 102 is pushed down, chamfers (not shown in FIG. 1, shown and described in FIG. 8) located on the seesaw-style latches 108 aid in automatic locking of the seesaw-style latches 108, and the seesaw-style latches 108 rotate, securing the seesaw-style latches 108 onto the lid 102, and locking the storage container 100 (not shown in FIG. 1, shown and described in detail in FIGS. 5A and 5B).

In some implementations, as the storage container 100 is locked, female recesses in a flange located on the lid 102 or base portion 104 receive male teeth located in a flange on the base portion 104 or lid 102, respectively (not shown in FIG. 1, shown and described in detail in FIGS. 5A and 5B). The female recesses in a flange of one component receive male teeth located in a flange of a different component prevent accidental or limp opening.

Figure 9A:
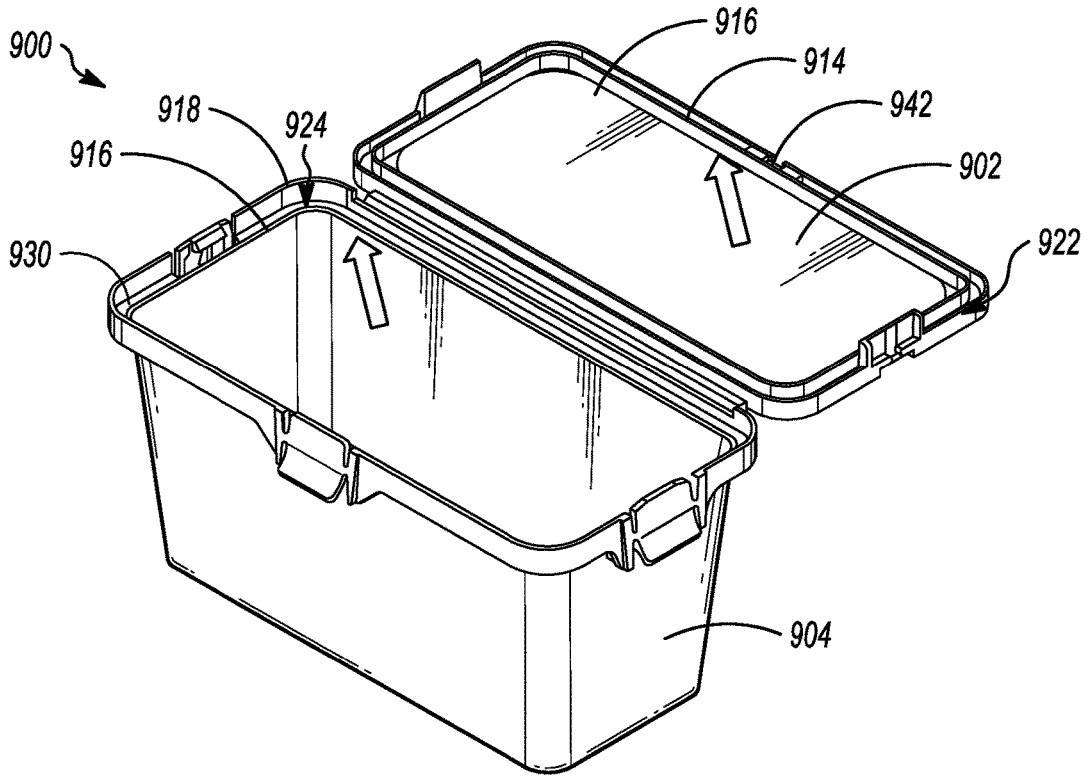
FIG. 9A illustrates a front perspective view of an example storage container, in an open and unlocked position.
Figure 9B:
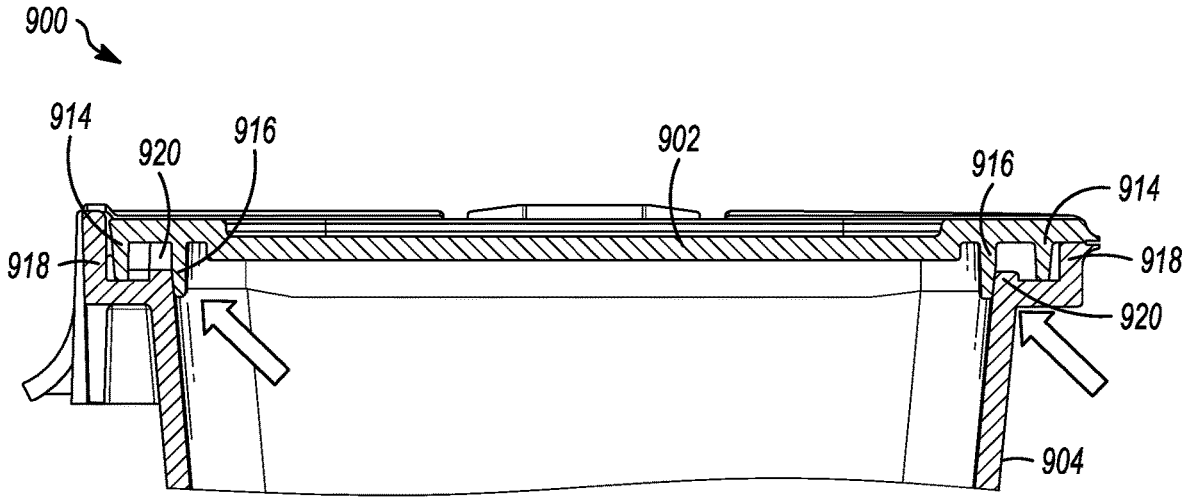
FIG. 9B illustrates a partial side isometric view of an example storage container, in a closed and locked position.

In some implementations, as the storage container 100 is locked, at least two opposing walls or flanges in the lid 102 and the base portion 104 interlock to prevent odor leakage and to keep the contents of the storage container 100 fresh (not shown in FIG. 1, shown and described in detail in FIGS. 9A and 9B). In one example, a flange located on the lid 102 or base portion 104 next to a flange or in a channel in between two flanges on the base portion 104 or lid 102, respectively.

Referring to FIG. 1A, to unlock the storage container 100, a flared end 110 of each seesaw-style latch 108 can be pushed downward (or depressed) in a direction toward the side of the base portion 104 when the storage container 100 is in a locked position, the seesaw-style latch 108 rotates and the seesaw-style latch 108 dislodges from a latch landing on the lid 102 from the base portion 104. When the seesaw-style latch 108 dislodges from the latch landing, the seesaw-style latch releases.

The seesaw-style latch 108 may be a torsion snap joint or a similar snap joint feature. In implementations where the seesaw-style latch 108 is a torsion snap joint, deflection is due to a torsional deformation of the fulcrum.

The storage container 100 is not unlocked and available for opening until each seesaw-style latch 108 is released. In some implementations, each seesaw-style latch 108 may be released simultaneously. In some implementations, each seesaw-style latch 108 may be released at a different time period. However, the entire storage container 100 will not be unlocked and available for opening until every seesaw-style latch 108 is released.

Figure 1B:
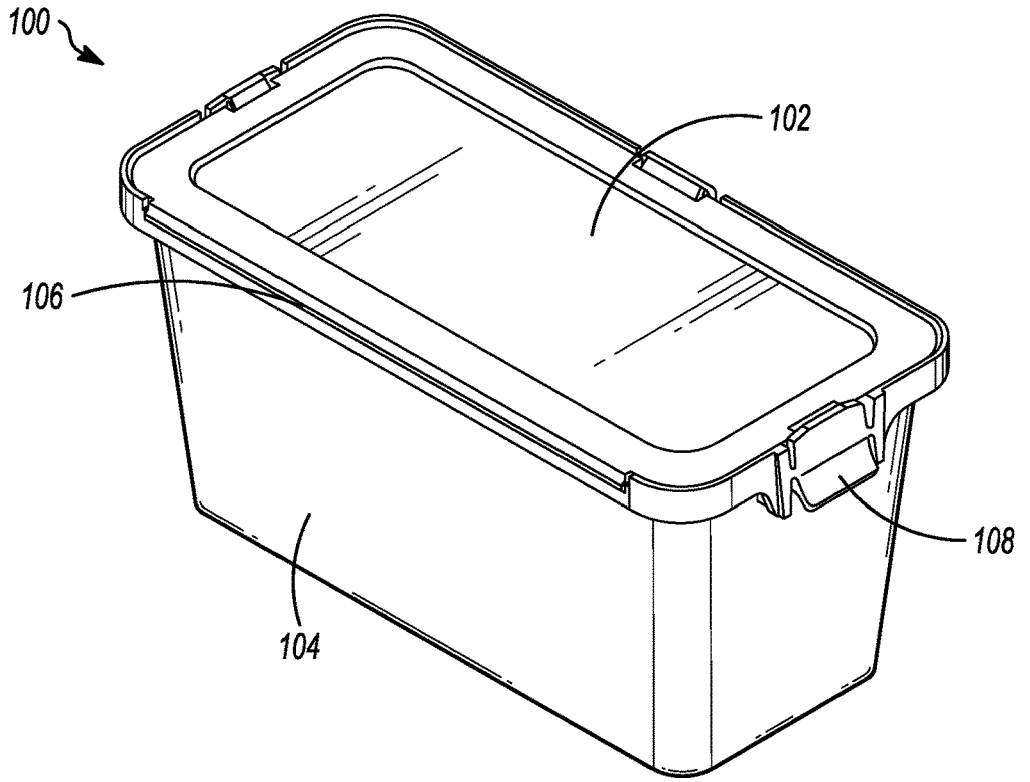
FIG. 1B illustrates a back perspective view of an example storage container in a closed and unlocked position.

FIG. 1B illustrates a back perspective view of an example storage container in a closed and unlocked position. As shown, the storage container 100 includes a lid 102 and a base portion 104. In some implementations, the lid 102 may be attached to the base portion 104 by a hinge 106. In some implementations, the hinge 106 is a living hinge. A living hinge allows for multiple storage containers 100 to be easily stacked for shipping purposes, for example. In another example, a living hinge keeps the lid 102 and the base portion 104 permanently attached. In some implementations, the hinge 106 may be any other available type of hinge, such as a spring hinge or non-living hinge. The hinge 106 constrains rotation on the lid 102 to facilitate opening of the storage container 100, as well as keeps the lid 102 attached to the base portion 104 as a convenience factor.

Figure 2:
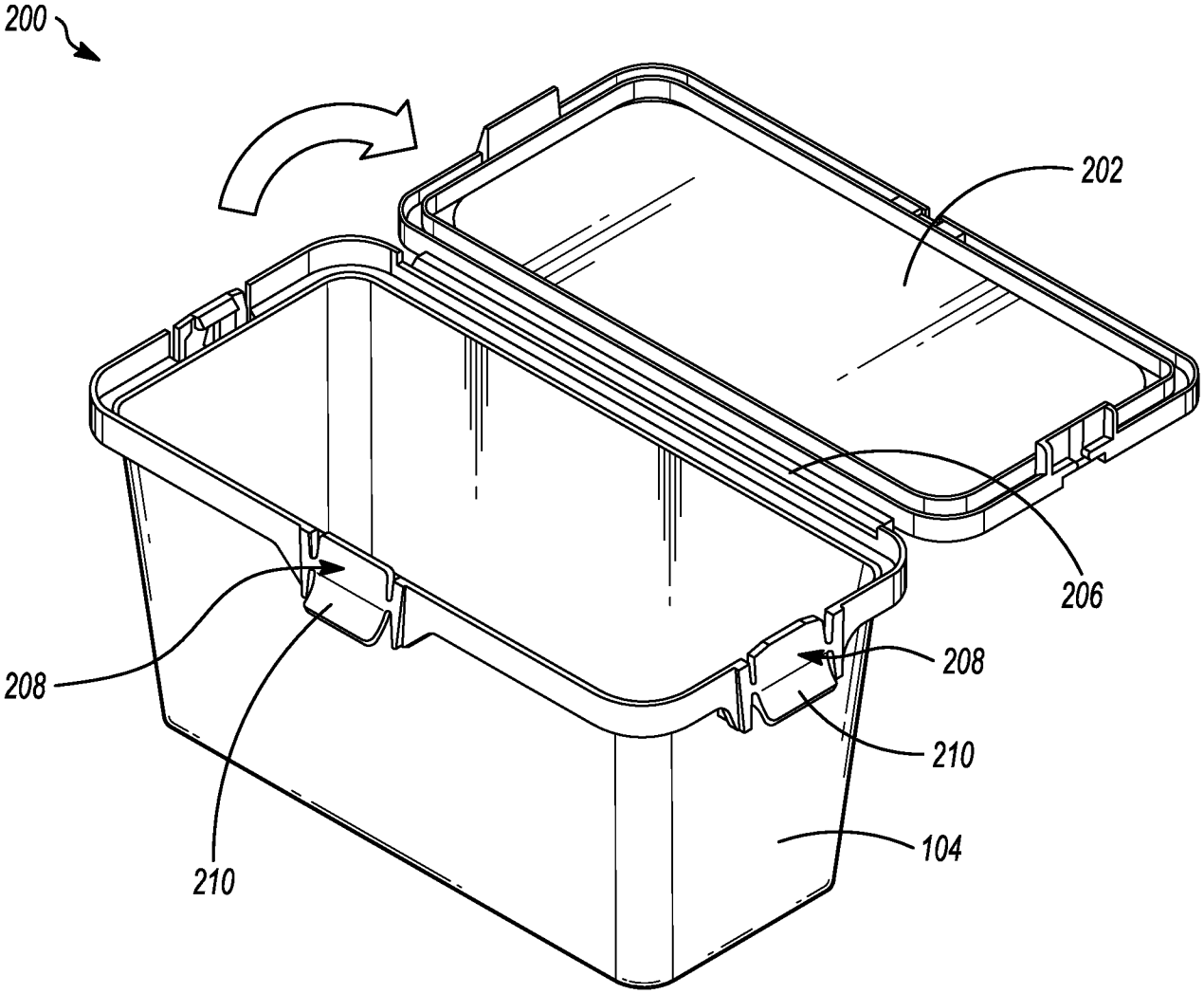
FIG. 2 illustrates a front perspective view of an example storage container, in an open and unlocked position.

FIG. 2 illustrates a front perspective view of an example storage container 200, in an open and unlocked position. The storage container 200 includes a lid 202 and a base portion 204, attached via a living hinge 206. In FIG. 2, the base portion 104 further includes three seesaw-style latches 208. In a closed position (not shown), the three seesaw-style latches 208 lock onto a latch landing 242 of a storage container 200, securing the lid 202 and the base portion 204. The seesaw-style latches 208 are configured to lock the base portion 204 to the lid 202 and unlock the base portion 204 from the lid 202 upon release of the seesaw-style latches 208. Specifically, each seesaw-style latch 208 includes a flared end 210. When the flared end 210 is pushed downward (or depressed) in a direction toward the side of the base portion 204, when the storage container 200 is in a locked position, the seesaw-style latch 208 rotates and the lip (not shown) of the seesaw-style latch 208 dislodges from the latch landing 242 on the lid 202. When the seesaw-style latch 208 dislodges from the latch landing 242, the seesaw-style latch releases 208. The arrow shown in FIG. 2 depicts the direction that the lid 202 can move when opening the storage container 200.

Figure 3B:
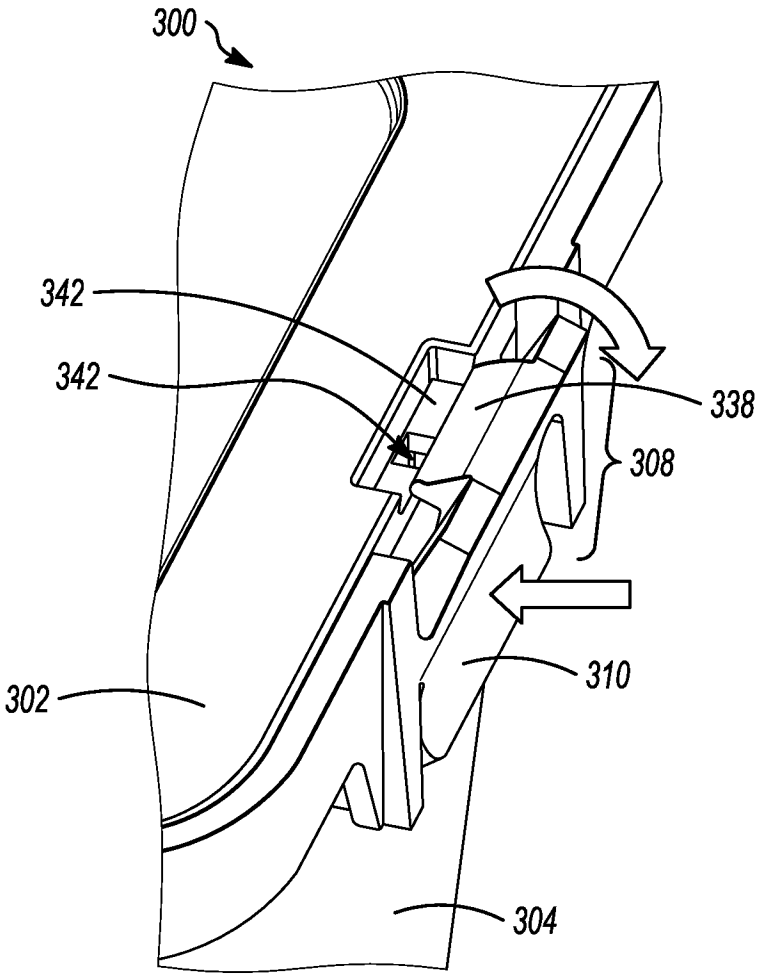
FIG. 3B illustrates a partial front perspective view of an example storage container, in a closed and locked position.
Figure 3A:
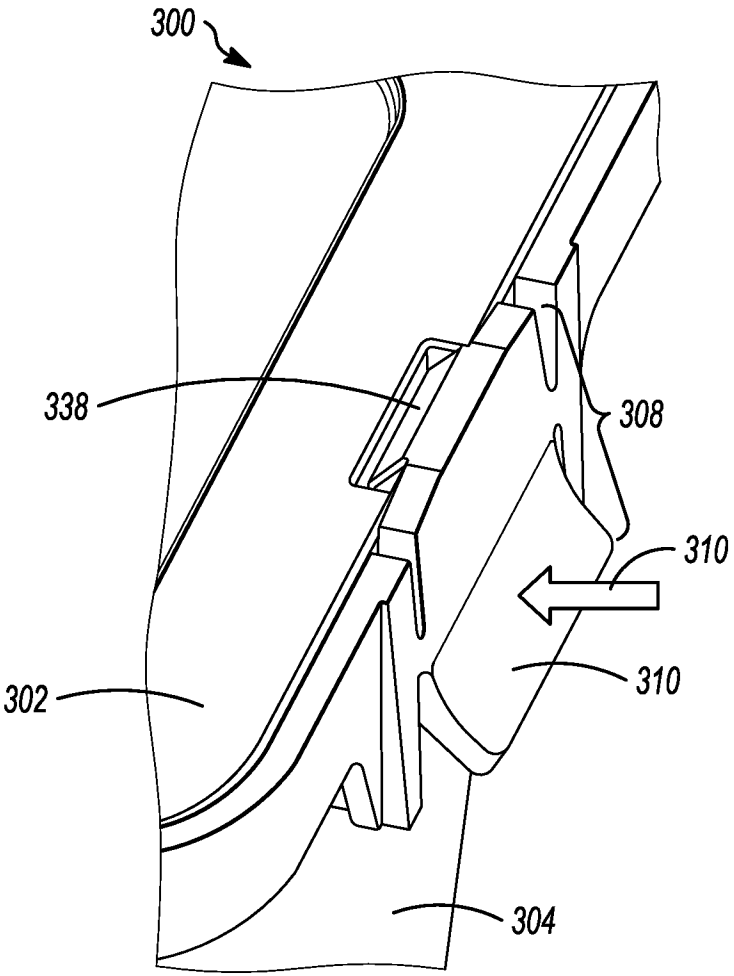
FIG. 3A illustrates a partial front perspective view of an example storage container, in a closed and locked position.

FIG. 3A illustrates a partial front perspective view of an example storage container 300, in a closed and locked position. In FIG. 3A, a seesaw-style latch 308 located on a base portion 304 of the front of the storage container 300 is locked onto a latch landing 342 (shown in FIG. 3B) via a lip 338 on the interior of the seesaw-style latch 308. The seesaw-style latch 308, in combination with other seesaw-style latches 308 located on the base portion 304 (not shown) are configured to lock the base portion 304 to the lid 302 and unlock the base portion 304 from the lid 302 upon release of the seesaw-style latches 308. Specifically, each seesaw-style latch 308 includes a flared end 310. When the flared end 310 is pushed downward (or depressed) in a direction toward the side of the base portion 304 (see arrow) when the storage container 300 is in a locked position, the seesaw-style latch 308 releases.

FIG. 3B illustrates a partial front perspective view of an example storage container 300, in a closed and locked position. In FIG. 3B, when the flared end 310 is depressed, the seesaw-style latch 308 rotates (see arrow) outward away from the lid and dislodges the lip 338 on the interior of the seesaw-style latch 108 from the latch landing 342 on the lid 302. When the seesaw-style latch 308 dislodges from the latch landing 342, the seesaw-style latch 308 releases. When all the seesaw-style latches 308 release, the storage container 300 is unlocked and opens.

A standing rib (not shown, shown and described in FIGS. 4A-C) is located on the interior side of the seesaw-style latch 308. In a locked position, the standing rib secures into a notch 344 in the latch landing 342. When the seesaw-style latch 308 releases from the lid 302, the standing rib prevents over-rotation of the seesaw-style latch 308, as the standing rib will contact the side of the base portion 304 and stop rotation of the seesaw-style latch 308.

Figure 4B:
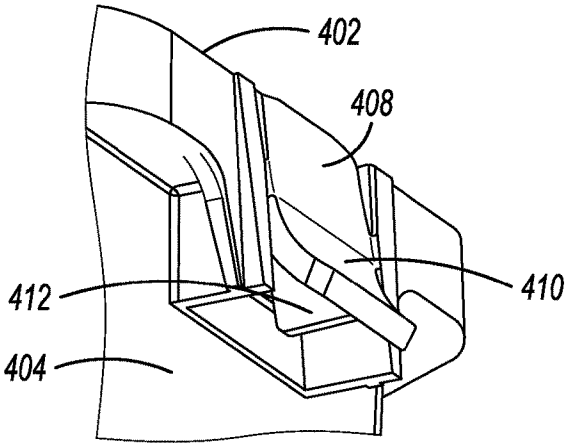
FIG. 4B illustrates a partial side perspective view of an example storage container, in a closed and locked position.
Figure 4C:
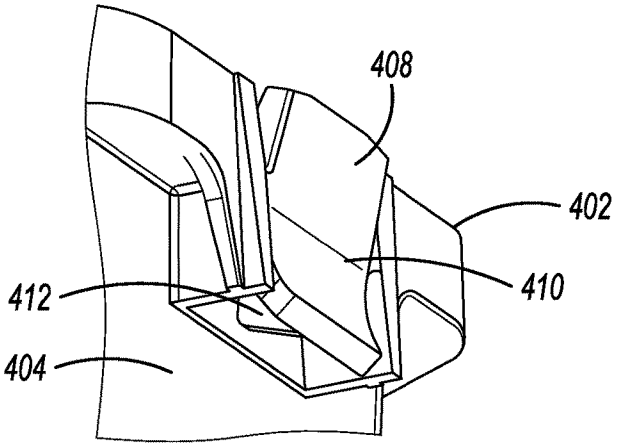
FIG. 4C illustrates a partial side perspective view of an example storage container, in an open and unlocked position.
Figure 4A:
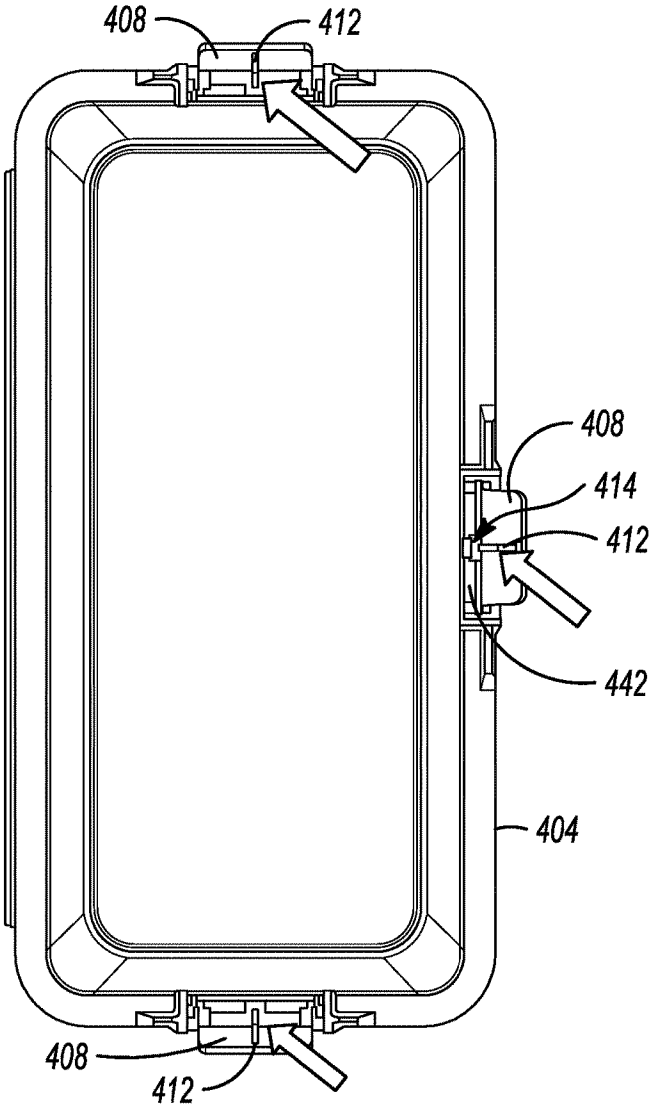
FIG. 4A illustrates a top view of an example storage container, in an open and unlocked position.

FIG. 4A illustrates a top view of an example storage container 400, in an open and unlocked position. In FIG. 4A, three seesaw-style latches 408 are located on a base portion 404 of the storage container 400. The seesaw-style latches 408 are configured to lock the base portion 404 to the lid 402 (shown in FIGS. 4B and C) and unlock the base portion 404 from the lid 402 upon release of the seesaw-style latches 408. Specifically, each seesaw-style latch 408 includes a flared end 410. When the flared end 410 is depressed, the seesaw-style latch 408 rotates outward away from the lid and dislodges from the latch landing 442 on the lid 402. When the seesaw-style latch 408 dislodges from the latch landing 442, the seesaw-style latch 408 releases. When all the seesaw-style latches 408 release, the storage container 400 is unlocked and opens.

A standing rib (e.g., standing rib 412) may be located on the interior side of each seesaw-style latch 408. When the storage container 400 is in a locked position, the standing rib secures into a notch (not shown in FIG. 4, shown in FIG. 3, notch 344) in a latch landing (not shown in FIG. 4, shown in FIG. 3B, latch landing 342).

When the seesaw-style latch 408 releases from the lid 402, the standing rib prevents over-rotation of the seesaw-style latch 408, as the standing rib will contact the side of the base portion 404 and stop rotation of the seesaw-style latch 408.

FIG. 4B illustrates a partial side perspective view of an example storage container 400, in a closed and locked position. The standing rib 412 is shown located on the interior side of the seesaw-style latch 408. In a closed and locked position, the standing rib secures into a notch in the latch landing (not shown) and does not contact the base portion 404.

FIG. 4C illustrates a partial side perspective view of an example storage container 400, in an open and unlocked position. The standing rib 412 is shown located on the interior side of the seesaw-style latch 408. In an open and unlocked position, the standing rib is no longer secured into a notch in the latch landing and contacts the base portion 404. Specifically, when the seesaw-style latch 408 releases from the lid 402 during unlocking and opening the storage container 400, the standing rib will contact the side of the base portion 404 and stop rotation of the seesaw-style latch 408, preventing over-rotation of the seesaw-style latch 408.

FIG. 5A illustrates a front perspective view of an example storage container 500 in a partially open and unlocked position. The storage container 500 includes a lid 502 and a base portion 504, attached via a living hinge 506 (shown in FIG. 5B). In FIG. 5A, the base portion 504 further includes three seesaw-style latches 508 (two seesaw-style latches 508 are shown). In a closed position (not shown), the three seesaw-style latches 508 lock onto a latch landing 542 of a storage container 500, securing the lid 502 and the base portion 504.

The seesaw-style latches 508 are configured to lock the base portion 504 to the lid 502 and unlock the base portion 504 from the lid 502 upon simultaneous release of the seesaw-style latches 508. Specifically, each seesaw-style latch 508 includes a flared end 510. When the flared end 510 is pushed downward (or depressed) in a direction toward the side of the base portion 504 when the storage container 500 is in a locked position, the seesaw-style latch 508 rotates and the seesaw-style latch 508 dislodges from the latch landing 542 on the lid 502 from the base portion 504. When the seesaw-style latch 508 dislodges from the latch landing 542, the seesaw-style latch releases 542 from the lid 502.

Referring to FIG. 5A, the lid 502 is shown with a lid exterior flange 514. The lid exterior flange 514 includes a plurality of male teeth (e.g., two male teeth 526). In FIG. 5A, the male teeth 526 are located on the front of the storage container 500. In some implementations, the male teeth 526 may be located in other areas (e.g., a side of a base portion 500, on a lid 502, etc.).

One function of the male teeth 526 is an extra layer of safety. The hinge 506 on the lid 502 has a light amount of inherent spring tension wanting to keep the lid 502 partially open. If, for some reason, the seesaw-style latches 508 were to fail or come inadvertently disengaged, the male teeth 526 hold the lid 102 closed so it does not automatically lift open.

The male teeth 526 also help build up force to cause the lid 502 to pop open when all three seesaw-style latches 508 have been activated properly. Pressing on the side seesaw-style latches 508 forces the lid 502 upwards, however the male teeth 526 hold the lid 502 down. A user is required to keep pressing on the side seesaw-style latches 508 until there is enough upward force to cause the lid 502 to skip out of the male teeth 526. This typically results in a faster, more energetic or active opening of the lid 502, which causes the lid 502 to open up further.

FIG. 5B illustrates a back perspective view of an example storage container 500 in an open and unlocked position. Referring to FIG. 5B, the base portion 504 includes a base portion exterior flange 518. The base portion exterior flange 518 includes a plurality of female recesses (e.g., two female recesses 528) to receive the male teeth 526 of the lid exterior flange 514 when the storage container 500 is closed and locked. The configuration of the female recesses 528 receiving the male teeth 526 prevents accidental or limp opening of the storage container 500.

Figure 6A:
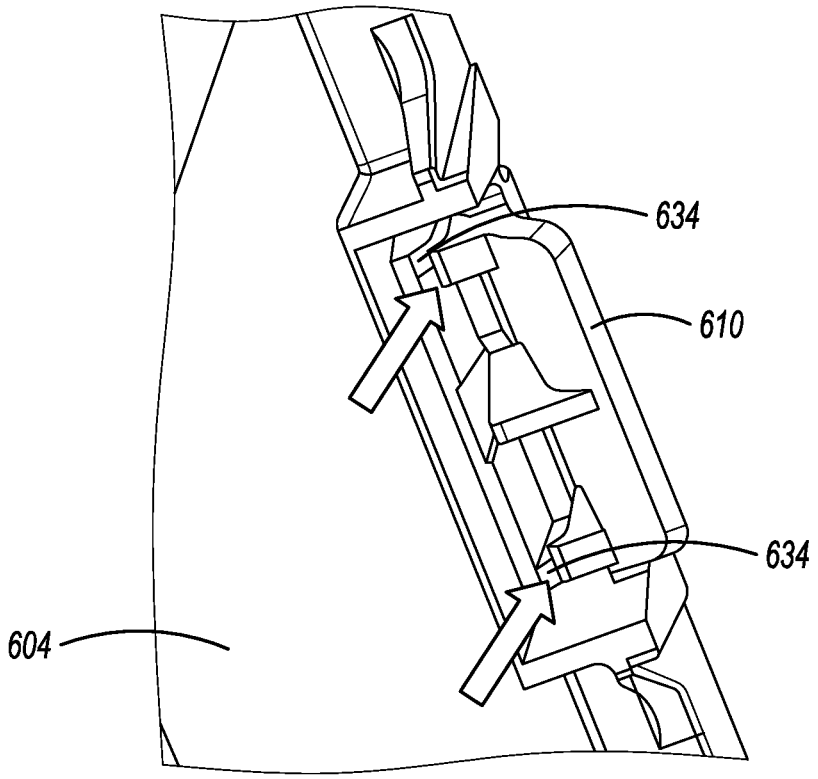
FIG. 6A illustrates a partial side perspective view of an example storage container, in a closed and locked position.

FIG. 6A illustrates a partial side perspective view of an example storage container 600, in a closed and locked position. In FIG. 6A, the underside of a seesaw-style latch 608 on a base portion 604 is shown. On a side opposite the flared end 610 of the seesaw-style latch 608, located proximal to the side of the base portion 604 is a circular tab 634. In some implementations, in locked and closed storage container 600, the circular tab 634 is configured to push against an angled surface of a standing wall (shown in FIG. 6B, standing wall 636, and FIG. 7, standing wall 736) on the lid 602. Specifically, when the side seesaw-style latches 608 of the storage container 600 are depressed, the circular tab 634 can push against the angled surface of the standing wall 636 and push the lid 602 to slide with upward pressure to reach a threshold that moves the male teeth (see male teeth 526 in FIG. 5) out of the female recesses. As a result, the storage container 600 provides a "pop" sound and the storage container 600 forcefully springs open in an active opening of the lid 602.

Figure 6B:
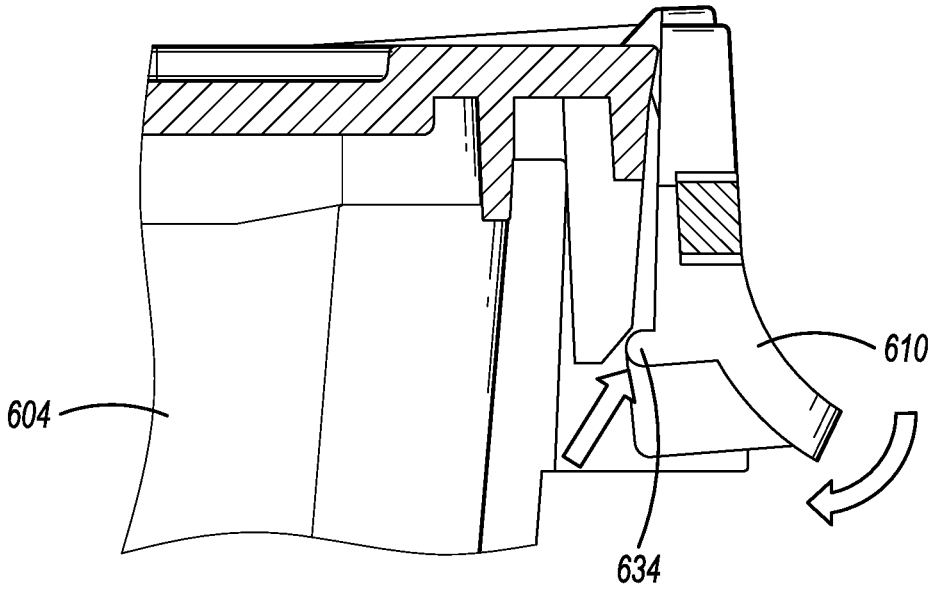
FIG. 6B illustrates a partial side isometric view of an example storage container, in a closed and locked position.

FIG. 6B illustrates a partial side isometric view of an example storage container 600, in a closed and locked position. Referring to FIG. 6B, the circular tab 634 is shown on the opposite side of the flared end 610 of the seesaw-style latch 608 and located adjacent the standing wall 636. The circular tab 634 is configured to push against the standing wall 636 on the lid 602 to provide an active opening of the lid 602. In some implementations, the circular tab 634 may be a different shaped tab (e.g., oval, rectangular, other geometric feature, etc.) and may be located in other areas of the seesaw-style latch 608.

Figure 7:
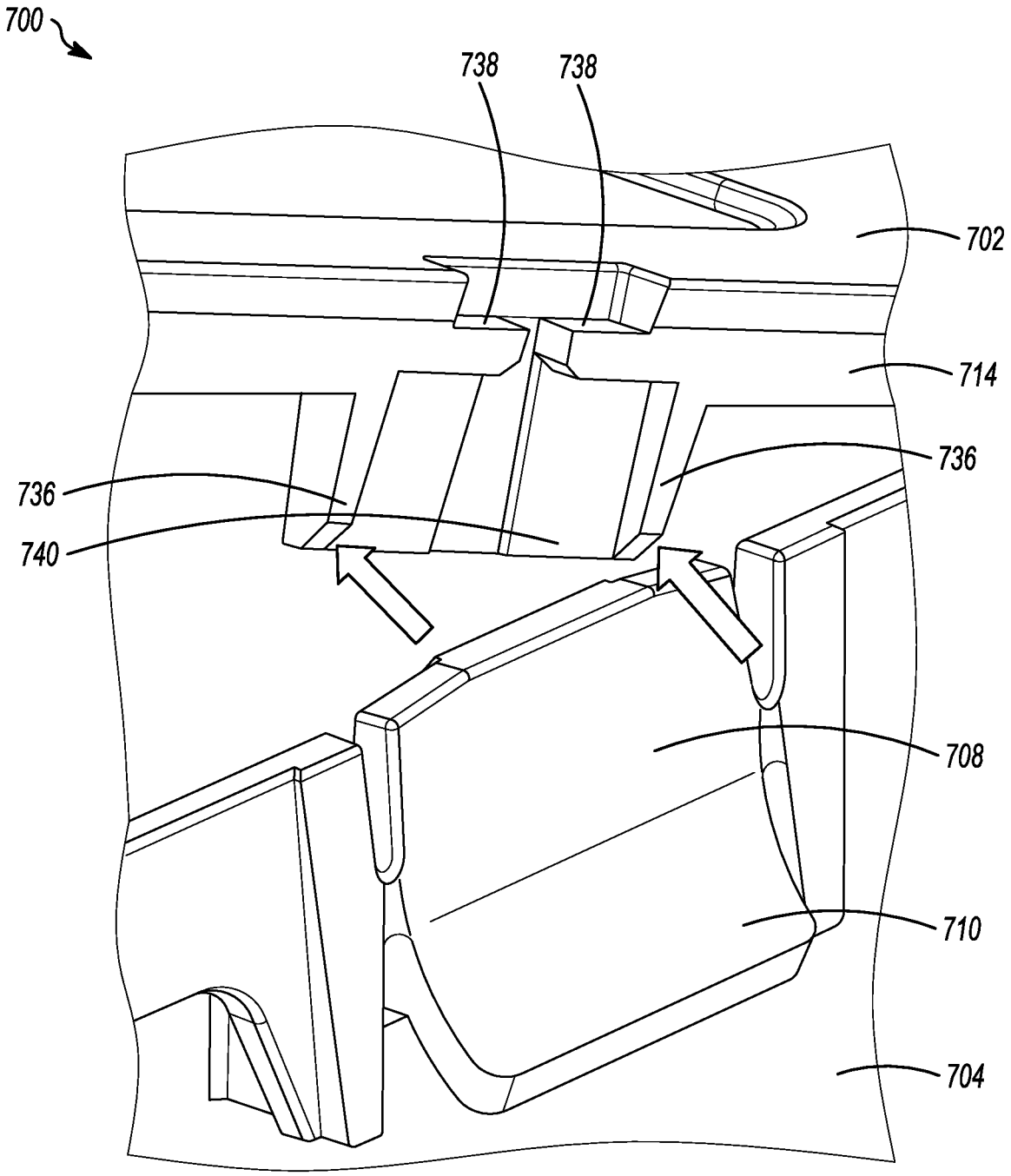
FIG. 7 illustrates a partial front perspective view of an example storage container in a partially open and unlocked position.

FIG. 7 illustrates a partial front perspective view of an example storage container 700, in a partially open and unlocked position. In FIG. 7, a seesaw-style latch 708 is shown located on a base portion 704 of the front of the storage container 700.

The seesaw-style latch 708, in combination with other seesaw-style latches 708 located on the base portion 704 are configured to lock the base portion 704 to the lid 702. The seesaw-style latch 708 may be locked onto a latch landing 742. The seesaw-style latch 708 can unlock the base portion 704 from the lid 702 upon release of the seesaw-style latch 708. Specifically, each seesaw-style latch 708 includes a flared end 710. When the flared end 710 is pushed downward (or depressed) in a direction toward the side of the base portion 704, when the storage container 300 is in a locked position, the seesaw-style latch 708 releases. In FIG. 7, standing walls 736 are located adjacent a lid wall 740 on the lid 702. Pressure applied to the standing walls 736 results in a forceful or active opening of the lid. In some implementations, the standing walls may be ramping surfaces or located adjacent ramping surfaces on the lid 702.

Figure 8:
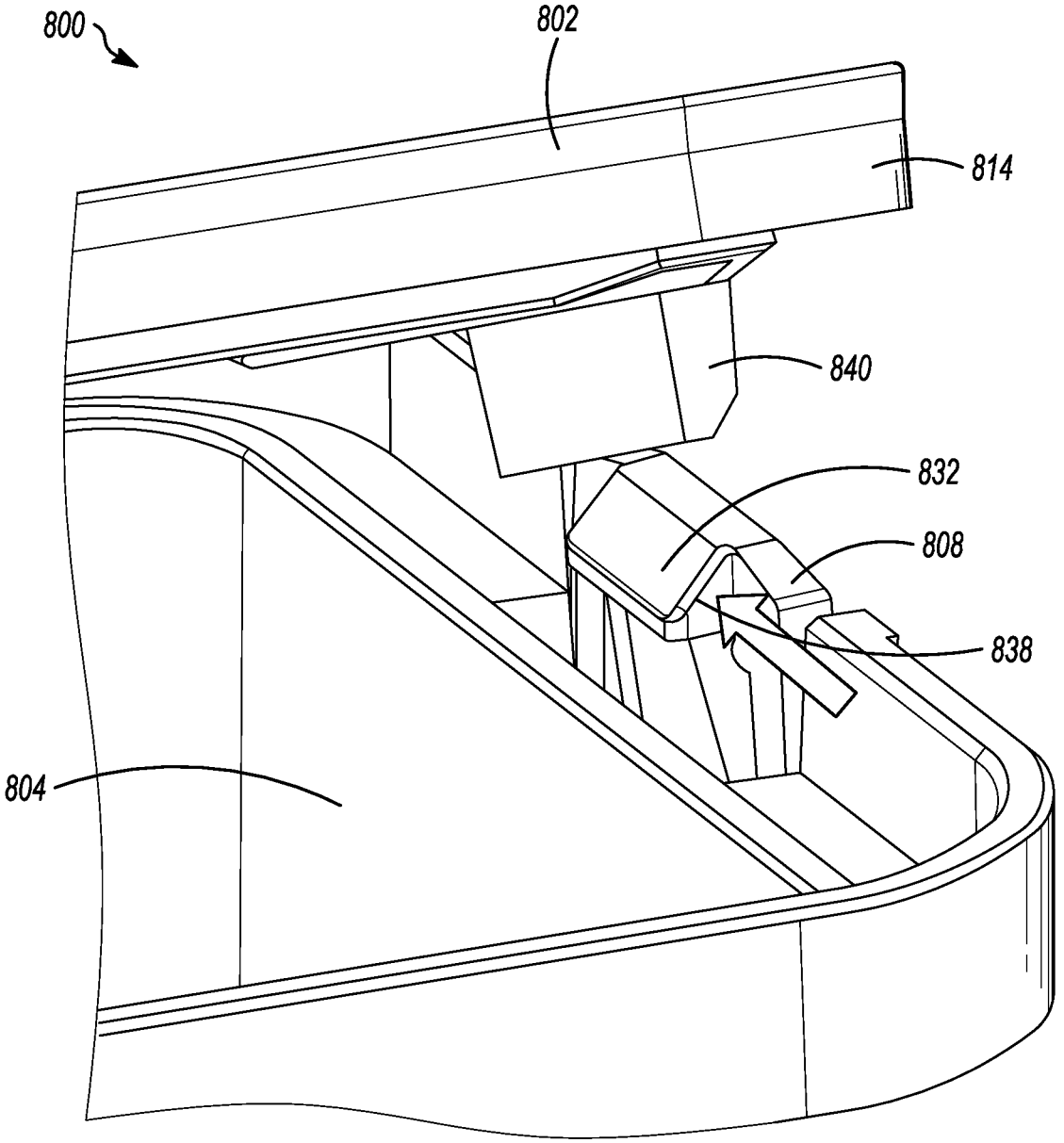
FIG. 8 illustrates a partial side perspective view of an example storage container in a partially open and unlocked position.

FIG. 8 illustrates a partial side perspective view of an example storage container 800, in a partially open and unlocked position. In FIG. 8, a seesaw-style latch 808 is shown located on a base portion 804 of the front of the storage container 800. The seesaw-style latch 808 may be locked onto a latch landing (not shown) of the lid 802. The seesaw-style latch 808, in combination with other seesaw-style latches 808 (not shown) located on the base portion 804 are configured to lock the base portion 804 to the lid 802 and unlock the base portion 804 from the lid 802 upon release of the seesaw-style latches 808. Specifically, each seesaw-style latch 808 includes a flared end (not shown). When the flared end is pushed downward (or depressed) in a direction toward the side of the base portion 804, when the storage container 800 is in a locked position, the seesaw-style latch 808 releases. In FIG. 8, a chamfer 832 on a lip 838 of the seesaw-style latch 808 is shown. The chamfer 842 aids in automatic locking the seesaw-style latches 808 when the lid 802 to being closed.

FIG. 9A illustrates a front perspective view of an example storage container 900, in an open and unlocked position. In FIG. 9, seesaw-style latches 908 are shown located on a base portion 904 of the front of the storage container 900. The seesaw-style latches 908 may be locked onto a latch landing 942. The seesaw-style latches 908 are configured to lock the base portion 904 to the lid 902 and unlock the base portion 904 from the lid 902 upon release of the seesaw-style latches 908. Specifically, each seesaw-style latch 908 includes a flared end 910. When the flared end 910 is pushed downward (or depressed) in a direction toward the side of the base portion 904, when the storage container 900 is in a locked position, the seesaw-style latch 908 releases.

In some implementations, as the storage container 900 is locked, at least two opposing walls or flanges in the lid 902 and the base portion 904 interlock to prevent odor leakage and to keep the contents of the storage container 900 fresh. In one example, a flange located on the lid 102 or base portion 104 next to a flange or in a channel in between two flanges on the base portion 104 or lid 102, respectively.

As shown in FIG. 9A, a lid exterior flange 914 and a lid interior flange 116 are located on the lid 902. A base portion exterior flange 918 and a base portion interior flange 920 are located the base portion 904. The lid 902 may be is sized for the lid exterior flange 916 to nest in a base portion channel 924 between the base portion exterior flange 918 and the base portion interior flange 920, and the lid exterior flange 914 to locate inside the base portion 904, when the storage container 900 is in a locked and closed position. These opposing walls (the lid exterior flange 916 and base portion exterior flange 918, and the lid exterior flange 916 and the base portion interior flange 920) seal the storage container 900.

The lid 902 or the base portion 904 may have channels created by flanges, and the channels may have varying depths, depending on an implementation. As shown in FIG. 9A, the storage container 900 may include a gasket 930 for sealing. The gasket 930 may be located in a channel of the lid 902 and/or the base portion 904.

FIG. 9B illustrates a partial side isometric view of an example storage container 900, in a closed and locked position. As shown, the lid exterior flange 914 and a lid interior flange 116 are located on the lid 902. A base portion exterior flange 918 and a base portion interior flange 920 are located the base portion 904. The lid exterior flange 916 is shown nesting in the base portion channel 924 (not shown as it is occupied by the lid exterior flange 916, shown in FIG. 9A) between the base portion exterior flange 918 and the base portion interior flange 920, and the lid exterior flange 914 to locate inside the base portion 904, when the storage container 900.

Figure 10:
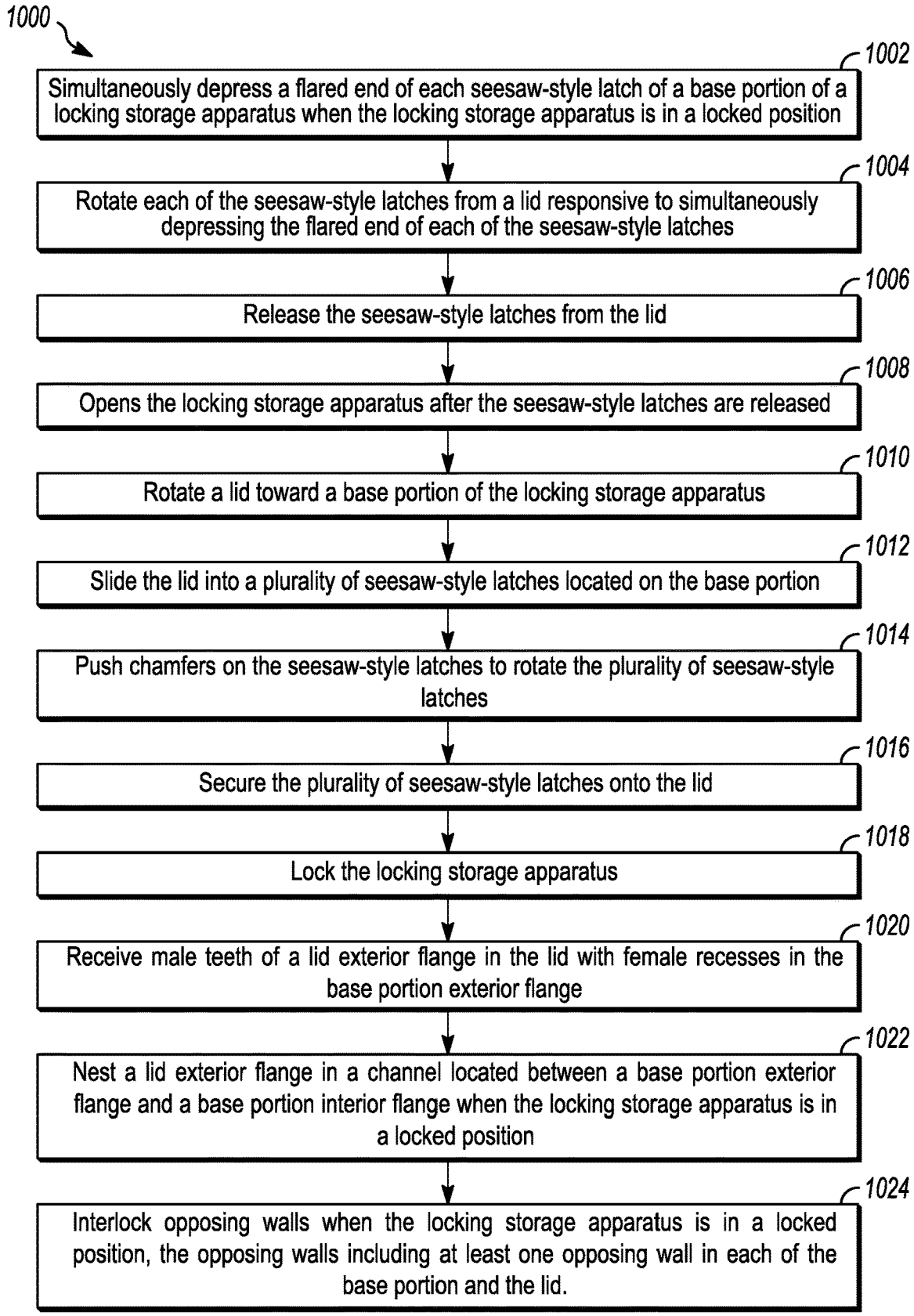
FIG. 10 is a flowchart of example operations to use a locked example storage container.

FIG. 10 illustrates a flowchart of example operations 1000 to use an example locking storage container. Operations 1002-1008 are directed to unlocking the locking storage container. An operation 1002 simultaneously depresses a flared end of each of a plurality of seesaw-style latches of a base portion of the locking storage apparatus when the locking storage apparatus is in a locked position. An operation 1004 rotates each of the plurality of seesaw-style latches from a lid responsive to depressing the flared end of each of a plurality of seesaw-style latches. An operation 1006 releases the plurality of seesaw-style latches from the lid. An operation 1008 opens the locking storage apparatus after the plurality of seesaw-style latches are released.

An operation 1008 rotates a lid toward a base portion of the locking storage apparatus. An operation 1010 slides the lid into a plurality of seesaw-style latches located on the base portion. An operation 1012 pushes chamfers on the plurality of seesaw-style latches to rotate the plurality of seesaw-style latches. An operation 1014 secures the plurality of seesaw-style latches onto the lid. An operation 1016 locks the locking storage apparatus. An operation 1018 receives a plurality of male teeth of a lid exterior flange in the lid with a plurality of female recesses in a base portion exterior flange. An operation 1020 nests a lid exterior flange in a channel located between a base portion exterior flange and a base portion interior flange when the locking storage apparatus is in a locked position. An operation 1022 interlocks at least two opposing walls when the locking storage apparatus is in a locked position, the at least two opposing walls including at least one opposing wall in each of the base portion and the lid.

The logical operations making up the embodiments of the invention described herein are referred to variously as operations, steps, objects, or modules. Furthermore, it should be understood that logical operations may be performed in any order, adding or omitting operations as desired, unless explicitly claimed otherwise or a specific order is inherently necessitated by the claim language.

The above specification, examples, and data provide a complete description of the structure and use of exemplary embodiments of the disclosed technology. Since many embodiments of the disclosed technology can be made without departing from the spirit and scope of the disclosed technology, the disclosed technology resides in the claims hereinafter appended. Furthermore, structural features of the different embodiments may be combined in yet another embodiment without departing from the recited claims.

What is claimed is:

1. A child-resistant storage container comprising:

a lid, including:

a plurality of male teeth; and a plurality of standing walls; and a base portion, the base portion including:

a plurality of female recesses configured to receive the male teeth;

a plurality of seesaw-style latches, the plurality of seesaw-style latches configured to lock the base portion to the lid and unlock the base portion from the lid responsive to simultaneous release of the plurality of seesaw-style latches, wherein each of the seesaw-style latches includes:

a flared end, wherein simultaneous depression of each flared end of each seesaw-style latch, when the child-resistant storage container is in a locked position, rotates each seesaw-style latch, dislodges each seesaw-style latch from a latch landing and unlocks the lid from the base portion; and wherein a tab located on at least one of the seesaw-style latches opposite the flared end is configured to push against an angled surface of one of the standing walls on the lid to push the lid with upward pressure to move the male teeth out of the female recesses and open the lid.

2. The child-resistant storage container of claim 1, wherein each seesaw-style latch includes a standing rib, the standing rib to prevent over-rotation of an associated seesaw-style latch.

3. The child-resistant storage container of claim 1, wherein the base portion and the lid each includes at least two opposing walls that interlock when the child-resistant storage container is in a locked position.

4. The child-resistant storage container of claim 1, wherein each seesaw-style latch includes a chamfer to facilitate closure of the child-resistant storage container.

5. The child-resistant storage container of claim 1, wherein the base portion is attached to the lid via a living hinge.

6. The child-resistant storage container of claim 1, wherein the plurality of seesaw-style latches are three seesaw-style latches.

7. The child-resistant storage container of claim 1, further comprising:

a gasket, the gasket located in a channel on at least one of the lid and the base portion.

8. The child-resistant storage container of claim 1, wherein the lid further comprises:

a lid exterior flange, the lid exterior flange including a plurality of male teeth.

9. The child-resistant storage container of claim 8, wherein the base portion further comprises:

a base portion exterior flange, the base portion exterior flange including a plurality of female recesses to receive the plurality of male teeth of the lid exterior flange.

10. The child-resistant storage container of claim 1, wherein the lid includes a lid exterior flange and a lid interior flange, and the base portion includes a base portion exterior flange and a base portion interior flange, and the lid is sized for the lid exterior flange to nest in a channel between the base portion exterior flange and the base portion interior flange, and the lid exterior flange to locate inside the base portion.

11. The child-resistant storage container of claim 1, wherein each seesaw-style latch is a torsion snap joint.

12. The child-resistant storage container of claim 1, wherein the at least one tab is configured to push against an angled surface of one of the standing walls on the lid when the seesaw-style latches are depressed and configured to push the lid with upward pressure moving the male teeth out of the female recesses to provide an active opening of the lid.

13. A child-resistant locking storage apparatus comprising:

a lid, the lid including:

a lid exterior flange, the lid exterior flange including a plurality of male teeth;

a plurality of lid walls; and a plurality of standing walls, at least two standing walls located adjacent to a lid wall;

a base portion, the base portion including:

a base portion exterior flange, the base portion exterior flange including a plurality of female recesses to receive the plurality of male teeth of the lid exterior flange when the child-resistant locking storage apparatus is locked; and three seesaw-style latches, the three seesaw-style latches configured to lock the child-resistant locking storage apparatus, wherein each seesaw-style latch is located on a wall of the base portion and includes:

a lip, the lip to lock onto a latch landing located on the lid;

a standing rib, the standing rib to prevent over-rotation of each seesaw-style latch; and a flared end, wherein simultaneous depression of each flared end when the child-resistant locking storage apparatus is in a locked position, rotates each seesaw-style latch, applies pressure against each standing wall, dislodges the seesaw-style latch from the latch landing, simultaneously releases each seesaw latch, and unlocks the lid from the base portion responsive to simultaneous release of all three seesaw-style latches, and wherein at least one tab located on one of the three seesaw-style latches opposite the flared end of the one of the three seesaw-style latches is configured to push against an angled surface of one of the standing walls on the lid when the one of the three seesaw-style latches is depressed, push the lid with upward pressure moving the male teeth out of the female recesses, and open the lid.

14. The child-resistant locking storage apparatus of claim 13, wherein the lid exterior flange nests in a channel between the base portion exterior flange and a base portion interior flange, and the lid exterior flange to locate inside the base portion when the child-resistant locking storage apparatus is in a locked position.

15. The child-resistant locking storage apparatus of claim 14, further comprising:

at least one gasket, the at least one gasket located in at least one of a first channel located in between the base portion exterior flange and the base portion interior flange and a second channel located in between the lid exterior flange and a lid interior flange.

16. A child-resistant locking storage apparatus of claim 13, wherein the at least one tab is configured to push against an angled surface of one of the standing walls on the lid when the seesaw-style latches are depressed and configured to push the lid with upward pressure moving the male teeth out of the female recesses to provide an active opening of the lid.

* * * * *